US007109942B2

(12) United States Patent
McCarville et al.

(10) Patent No.: US 7,109,942 B2
(45) Date of Patent: Sep. 19, 2006

(54) STRUCTURALLY INTEGRATED PHASED ARRAY ANTENNA APERTURE DESIGN AND FABRICATION METHOD

(75) Inventors: Douglas A. McCarville, Auburn, WA (US); Gerald F. Herndon, Redmond, WA (US); Joseph A. Marshall, IV, Lake Forest Park, WA (US); Robert G. Vos, Auburn, WA (US); Isaac R. Bakker, Seattle, WA (US); David L. Banks, Bellevue, WA (US)

(73) Assignee: The Boeing Company, Chicago, IL (US)

( * ) Notice: Subject to any disclaimer, the term of this patent is extended or adjusted under 35 U.S.C. 154(b) by 20 days.

(21) Appl. No.: 10/970,702

(22) Filed: Oct. 21, 2004

(65) Prior Publication Data

US 2006/0097947 A1 May 11, 2006

(51) Int. Cl.
*H01Q 21/26* (2006.01)

(52) U.S. Cl. ..... 343/797; 343/705

(58) Field of Classification Search ..... 343/797, 343/795, 700 MS, 705
See application file for complete search history.

(56) References Cited

U.S. PATENT DOCUMENTS 3,836,976 A * 9/1974 Monser et al. ..... 343/795
4,219,820 A * 8/1980 Crail ..... 343/756
4,686,536 A * 8/1987 Allcock ..... 343/700 MS
5,184,141 A 2/1993 Connolly et al.
5,786,792 A * 7/1998 Bellus et al. ..... 343/770
5,845,391 A * 12/1998 Bellus et al. ..... 29/600
6,359,596 B1 * 3/2002 Claiborne ..... 343/795
6,424,313 B1 7/2002 Navarro et al.
6,552,691 B1 * 4/2003 Mohuchy et al. ..... 343/770
2004/0151876 A1 8/2004 Tanielian
2005/0078046 A1 * 4/2005 Theobold et al. ..... 343/797

OTHER PUBLICATIONS

Wallace, Jack; Redd, Harold; and Furlow, Robert; "Low Cost MMIC DBS Chip Sets For Phased Array Applications," IEEE, 1999, 4 pages.

* cited by examiner

*Primary Examiner*—Hoang V. Nguyen
(74) *Attorney, Agent, or Firm*—Harness Dickey & Pierce P.L.C.

(57) ABSTRACT

An antenna aperture and method of assembling same. The antenna aperture forms a honeycomb-like core structure with dipole radiating elements integrally formed into structural wall portions of the honeycomb-like core. The antenna aperture has sufficient structural strength to form a structural portion of a mobile platform, while still being sufficiently light in weight for weight-critical applications such as with airborne mobile platforms.

25 Claims, 11 Drawing Sheets

| | Shear | Flatwise | Bending | Compression |
|---|---|---|---|---|
| For Antenna 10 Honeycomb Like Core Of 11.7 Lbs./Sq. Ft. | 557 lb | 698 lb | 1015 lb | 3100 lb |
| Conventional 12 Lbs./Sq. Ft. HRP® Core | 531 lb | 625 lb | 1000 lb | 2080 lb |

STRUCTURALLY INTEGRATED PHASED ARRAY ANTENNA APERTURE DESIGN AND FABRICATION METHOD

This invention was made with Government support under Contract Number F33615-97-2-3220 awarded by the United States Air Force. The U.S. Government has certain rights in this invention.

CROSS REFERENCE TO RELATED APPLICATIONS

This application includes subject matter related to the following U.S. applications filed concurrently with the present application: Ser. No. 10/970,710; Ser. No. 10/970,703 now U.S. Pat. No. 7,046,209; and Ser. No. 10/970,711, all of which are incorporated by reference into the present application.

FIELD OF THE INVENTION

The present invention relates to antenna systems, and more particularly to a phased array antenna aperture constructed in a manner that enables it to be used as a structural, load-bearing component, such as in connection with a wing or fuselage of an airborne mobile platform.

BACKGROUND OF THE INVENTION

Present day mobile platforms, such as aircraft (manned and unmanned), spacecraft and even land vehicles, often require the use of a phased array antenna aperture for transmitting and/or receiving electromagnetic wave signals. Such antenna arrays are typically formed by a plurality of antenna elements assembled into an X-Y grid-like arrangement on the mobile platform. There is often weight from various components on which the radiating elements of the antenna are mounted, such as aluminum blocks or other like substructures, that form "parasitic" weight. By "parasitic" it is meant weight that is associated with components of the antenna aperture that are not directly necessary for transmitting or receiving operations, such as aluminum or metallic components on which antenna probes are supported. By providing an antenna aperture that is able to form a load bearing structure of a mobile platform, such as a portion of a wing, a portion of a skin of a fuselage, a portion of a door, or any other structural portion of a mobile platform, the number and nature of sensor functions capable of being implemented on the mobile platform can be increased significantly over conventional electronic antenna and sensor systems that require physical space within the mobile platform. An antenna that forms a structural portion of the mobile platform also would eliminate the aerodynamic drawbacks that the antenna aperture itself would give rise to or which must be designed in connection if the antenna aperture was to be mounted on an exterior surface of the mobile platform.

Providing a phased array antenna aperture that can form a structural portion of a mobile platform, and which is also comparable in weight to conventional composite honeycomb-like structural panels, and that could be manufactured with sufficient accuracy and to the high tolerance that is needed for precision antenna apertures, would allow a greater number of antennal/sensor applications to be implemented on a mobile platform over what is now possible with present day sensor systems that must be mounted within, or on an exterior surface of, a mobile platform. Such an antenna system would also potentially allow even greater sized antenna apertures to be implemented than what would otherwise be possible if the antenna aperture was required to be mounted within the mobile platform or on its external surface.

SUMMARY OF THE INVENTION

The present invention is directed to an antenna aperture that is able to form a structural, load-bearing portion of a mobile platform or other structure, as well as to a method of making such an aperture. The antenna aperture of the present invention is especially well-suited for use with mobile platforms such as manned and unmanned aircraft, spacecraft and other high-speed mobile platforms, where lightweight, high structural strength and rigidity are important operational considerations.

In one preferred form the antenna aperture comprises a honeycomb-like core structure formed from composite materials. The core can also be viewed as forming an "egg crate" construction.

A plurality of dipole radiating elements are integrated into the walls of the honeycomb-like core to form integral portions of the walls. Precise wall thicknesses, and thus precise spacing of the dipole antenna elements relative to one another throughout the walls of the antenna structure, is a principal feature of the present invention in obtaining the desired antenna performance at frequencies in the GHz range. Since the antenna elements are physically integrated into the honeycomb-like core structure, there is no need for parasitic supporting structures, such as aluminum blocks or mandrels that would otherwise add significant weight to the overall antenna aperture. The antenna aperture forms a structurally rigid, lightweight composite structure that is suitable for use as a load bearing portion of a mobile platform.

In a preferred method of manufacturing the antenna aperture, precision dimensioned aluminum blocks are provided that are first wrapped with a composite prepreg material. A substrate having an antenna radiating element formed thereon is then placed over the aluminum block in a precise orientation to form a single antenna cell having single polarization capability. A second substrate having a second antenna element formed thereon may be positioned on the aluminum block in a direction orthogonal to the first substrate, if a dual polarization antenna element is desired.

A plurality of antenna cells are constructed as described above and then arranged in a row. Each of the aluminum blocks incorporates a locating component that allows each of the substrates, with its associated antenna element, to be precisely aligned on its associated metallic block. A plurality of rows of antenna cells are formed as described above, and each row is compacted and then allowed to cure for a predetermined time.

After each row of antenna cells has cured, each of the rows is assembled into a grid-like arrangement that comprises both rows and columns of cells. An outer perimeter of the grid-like assembly is then wrapped with a composite prepreg material and the entire assembly is compacted. The assembly is then placed on a back skin material, an alignment member is placed over an upper surface of each of the cells to further maintain precise dimensional alignment of each of the cells relative to one another, tools are secured adjacent exterior surfaces of the assembled grid-like structure, and the entire structure is then compacted and cured. After curing, the tools are removed, the alignment member previously placed over the upper surface of the grid-like assembly is removed, and the upper portion of each antenna cell is cut such that the metallic block of each antenna cell can be removed. Once all of the metallic blocks are removed, an antenna aperture having a honeycomb-like core structure (or "egg crate" core) is provided. Since the metallic blocks are removed, the resulting antenna aperture does not have the parasitic weight that would otherwise normally be associated with such an array of antenna elements. The construction method described above further allows arrays of widely varying dimensions and shapes to be constructed with the dimensional accuracy needed for many high frequency antenna and sensor applications.

The features, functions, and advantages can be achieved independently in various embodiments of the present inventions or may be combined in yet other embodiments.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
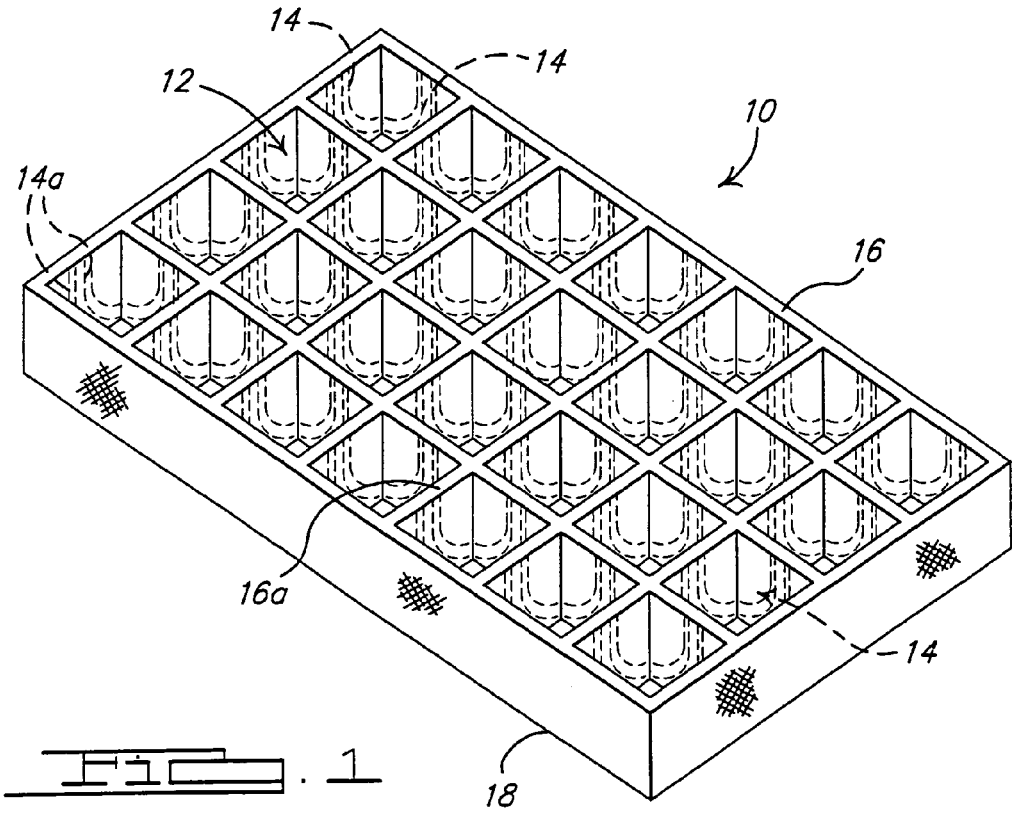
FIG. 1 is a simplified perspective view of an antenna aperture formed in accordance with a preferred embodiment of the present invention.

An antenna aperture 10 in accordance with a preferred embodiment of the present invention is shown in FIG. 1. The antenna aperture 10 has a honeycomb-like core structure and is suitable for use as a load bearing component on a mobile platform or other load bearing structure. The antenna aperture 10, however, is especially well-suited for use in airborne mobile platforms where light weight and high structural strength for various portions of an airframe are desired. The antenna aperture 10 has sufficient structural strength to form a primary aircraft structure and can be integrated into an airframe for use as a skin panel on a fuselage, wing, door or other portion of an aircraft or spacecraft.

The antenna aperture 10 includes a plurality of antenna cells 12 formed in an X-Y grid-like (i.e., honeycomb-like) structure. Each of the antenna cells 12 includes a plurality of antenna elements 14, which in one preferred form may comprise dipole antennas. While each antenna cell 12 is illustrated with a plurality of four walls, with each of the four walls including an antenna element 14 formed therein, it will be appreciated that each cell 12 could be formed with a lesser plurality of elements 14. The use of four dipole radiators with each antenna cell 12 provides the antenna aperture 10 with dual polarization capability. Providing only two antenna elements 14 on a pair of opposing walls of each cell 12 would provide each cell with single polarization capability.

The walls of each cell 12 are formed by composite materials that effectively sandwich the antenna elements 14 between plies of composite materials during the manufacturing of the antenna aperture 10. As will be described in greater detail momentarily, the manufacturing process allows the antenna aperture 10 to be created with a high degree of dimensional precision and tolerance for spacing the antenna elements that are needed for various antenna and sensor applications, and particularly, high frequency antenna applications in the GHz range. Since the antenna aperture 10 does not include any metallic supporting structure that would otherwise normally be used to support the antenna elements 14, the overall antenna aperture 10 is light in weight as compared to other forms of phased array antennas that make use of metallic materials acting as substrates or other support surfaces for the radiating elements. Although in practice the antenna aperture 10 will have its upper edge surface 16 and its lower edge surface 18 covered with composite materials, these portions have been omitted to better show the honeycomb-like core structure collectively formed by the individual antenna cells 12.

Figure 2:
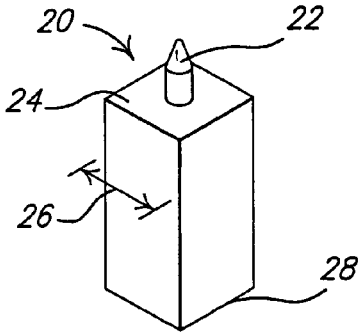
FIG. 2 is a perspective view of a metallic element used to form the antenna components used to make the entire aperture of FIG. 1.

The method of forming the antenna aperture 10 will now be described. Referring initially to FIG. 2, a precision metallic element 20 is provided for forming each of the antenna cells 12. The metallic element 20 preferably comprises a solid aluminum block of precise dimensions and has a locator pin 22 protruding from one end surface 24 thereof. In practice, the overall dimensions of the metallic element 20 may vary significantly, but for an antenna or sensor to be operated in the GHz frequency range, element 20 will typically be on the order of about 0.5" (12.7 mm) square in cross-section and on the order about 1.0"–2.0" (25.4–50.8 mm) in height. However, it will be appreciated that these dimensions can vary significantly depending upon the antenna performance characteristics that are desired, and in particular, on the frequency band in which the antenna aperture 10 is intended to be used. Metallic element 20 also has a highly polished outer surface and may include a slight draft of one degree or so, so that the cross-sectional area of the element at surface 24 is slightly less than the area of the element at bottom surface 28. Locator pin 22 is also located at an axial center of the element 20. While the element 20 is shown as being square shaped, other shapes (e.g., triangular, circular, hexagonal) could also be implemented.

Figure 3:
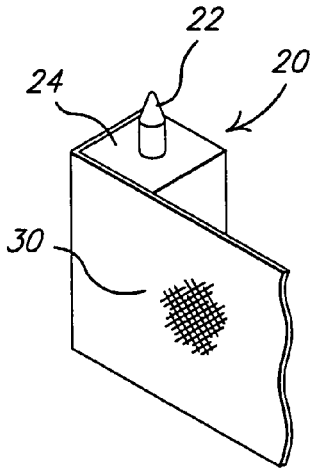
FIG. 3 illustrates a resin rich prepreg section of fabric being wrapped around the metallic element.
Figure 4:
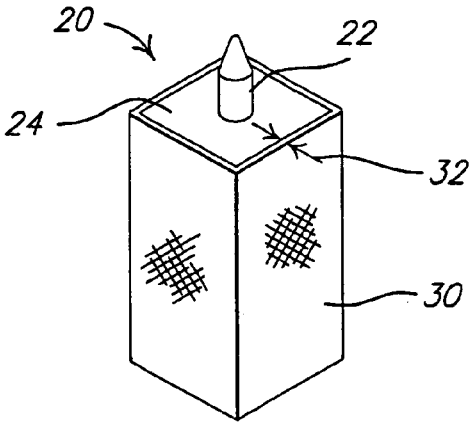
FIG. 4 illustrates the metallic element of FIG. 3 covered on all four sides by the prepreg fabric.
Figure 5:
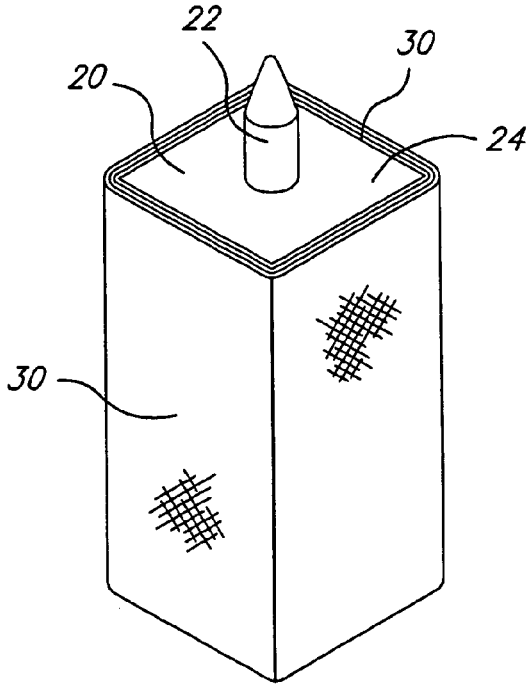
FIG. 5 illustrates multiple layers of prepreg fabric wrapped around a metallic element.

Referring to FIG. 3, the metallic element 20 is first wrapped along its longitudinal sides with a resin-rich composite prepreg fabric 30. Prepreg 30 is wrapped so as to completely cover the outer side surfaces of the metallic element 20, as shown in FIG. 4. Preferably, two or more layers of resin-rich prepreg fabric are wrapped over the metallic element 20. The precise number of layers depends upon the overall desired wall thickness, indicated by arrows 32 in FIG. 4. Each layer of prepreg fabric is typically on the order of about 0.005"–0.10" (0.127–2.54 mm) thick. For most applications of the antenna aperture 10, a preferred overall wall thickness in the range of about 0.015"–0.030" (0.381–0.762 mm) will be desired. A wall thickness within the range of 0.015"–0.03" will allow the antenna aperture 10 to provide a load capacity of about eight pounds per cubic foot, which is similar to the performance of a HRP® fiberglass honeycomb core. FIG. 5 illustrates the metallic element 20 with several layers of prepreg material 30 wrapped thereon.

Figure 6:
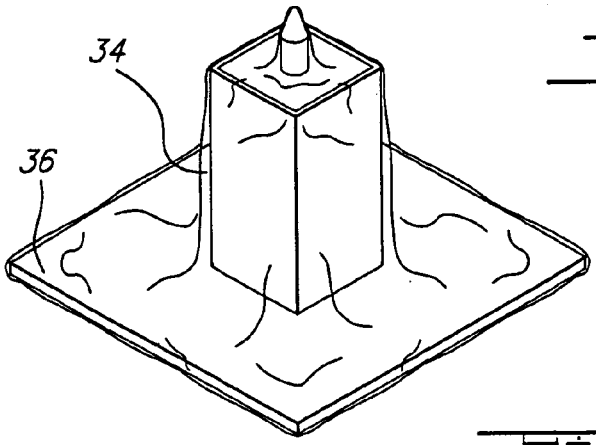
FIG. 6 illustrates the component of FIG. 5 placed within a vacuum bag for vacuum compacting.
Figure 7:
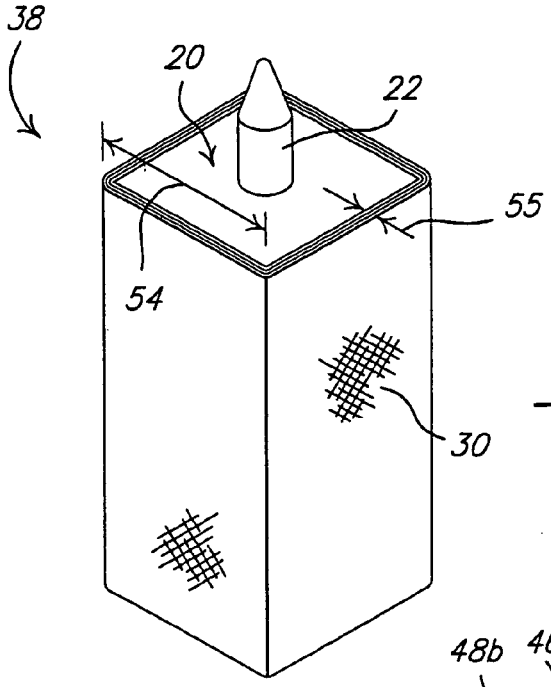
FIG. 7 illustrates the assembly of FIG. 5 after compaction.

In FIG. 6, the metallic element 20 shown in FIG. 5 is placed within a vacuum bag 34 and vacuum compacted to remove air from between the individual fabric prepreg plies 30. Vacuum bag 34 cooperates with a table portion 36 of a conventional vacuum compaction assembly to compact the individual plies of prepreg 30 such that the overall wall thickness 32 (FIG. 4) is reduced by about 0.002"–0.005" (0.0508–0.127 mm). The compacted subassembly component, after removal of the vacuum bag 34, is illustrated in FIG. 7 and denoted by reference numeral 38.

Figure 8:
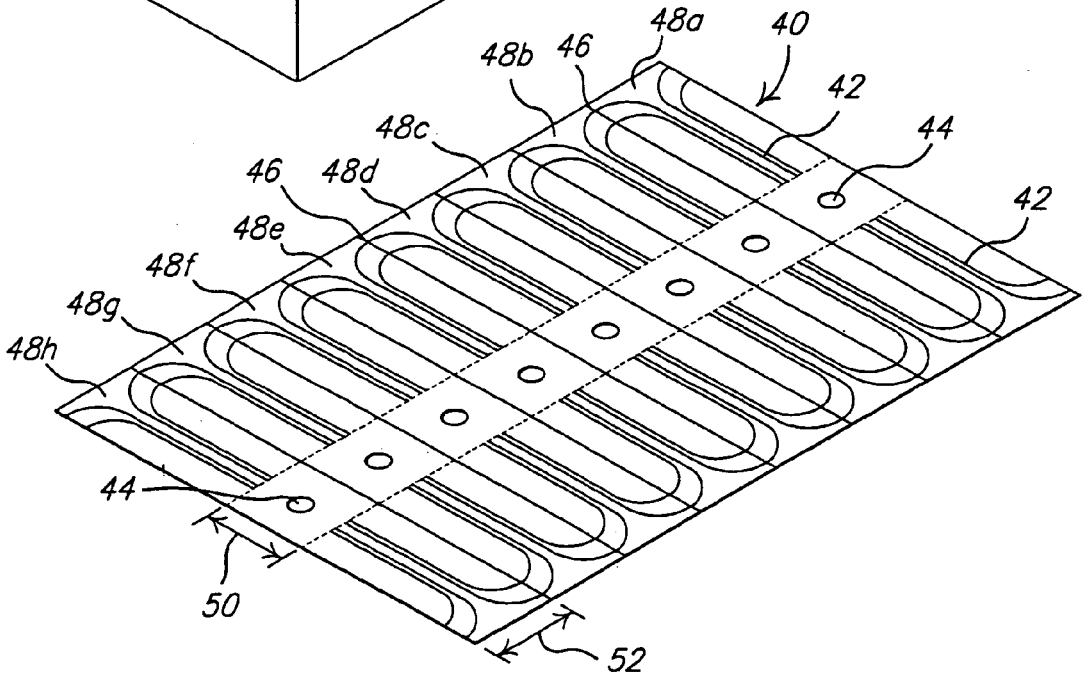
FIG. 8 illustrates a planar length of material forming a plurality of antenna radiating components.

Referring to FIG. 8, a sheet of material 40 with the plurality of dipole antenna radiating elements 14 is illustrated. Material sheet 40 is preferably formed from a polyimide film acting as a carrier sheet, and more preferably from Kapton® polyimide film having a thickness of typically in the range of about 0.010 inch–0.040 inch (0.254 mm–1.016 mm). Copper is coated onto the Kapton® polyimide film and then etched away to form copper traces in the form of dipole radiating elements 42 that together form each antenna radiating element 14. Holes 44 are also formed along the material sheet 40 each with a diameter enabling the locating pin 22 of each metallic element 20 to be received therethrough. Material sheet 40 is cut along lines 46 to form a plurality of independent antenna radiating components 48*a*–48*h*. Each antenna radiating component 48*a*–48*h* is further formed such that radiating elements 14 are spaced apart by a distance represented by arrow 50. This distance corresponds to the approximate cross-sectional length of subassembly component 38 after the previously described compaction step. The overall width of each antenna radiating component 48*a*–48*h*, as designated by arrow 52, is further selected such that it is just slightly smaller than the width, designated by arrow 54 in FIG. 7, of each subassembly component 38.

Figure 9:
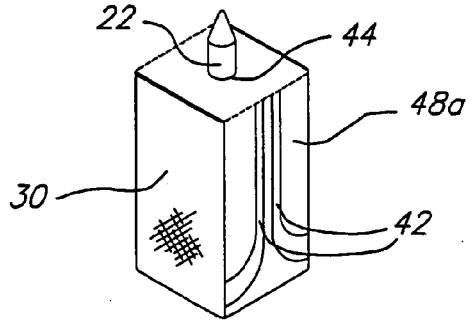
FIG. 9 illustrates one of the antenna radiating components wrapped around the compacted assembly of FIG. 7.
Figure 10:
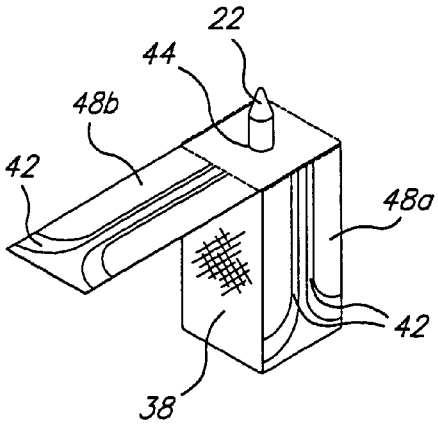
FIG. 10 illustrates a second antenna radiating element wrapped around the component of FIG. 9.
Figure 11:
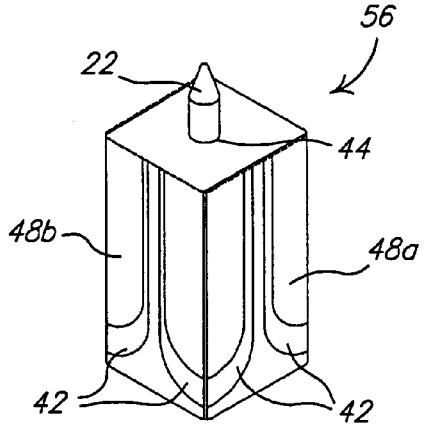
FIG. 11 illustrates the component of FIG. 10 having dipole radiating elements on all four sides.

Referring to FIG. 9, the first one of the antenna radiating components 48*a* is wrapped over subassembly component 38 such that the locating pin 22 is received through hole 44. The tackiness of the prepreg material 30 helps to secure the component 48*a* to the component 38. Referring to FIG. 10, a second one of the antenna radiating components 48*b* is then wrapped over the component 38 orthogonally to radiating component 48*a*, and such that its hole 44 also receives the locating pin 22. Antenna radiating component 48*b* covers the previously uncovered prepreg material 30. An antenna component 56 is thus formed with the two radiating components 48*a* and 48*b* covering all four sides of the component 38, as shown in FIG. 11. Dipole radiating elements 42 are thus present on all four longitudinal sides of antenna component 56.

Figure 12:
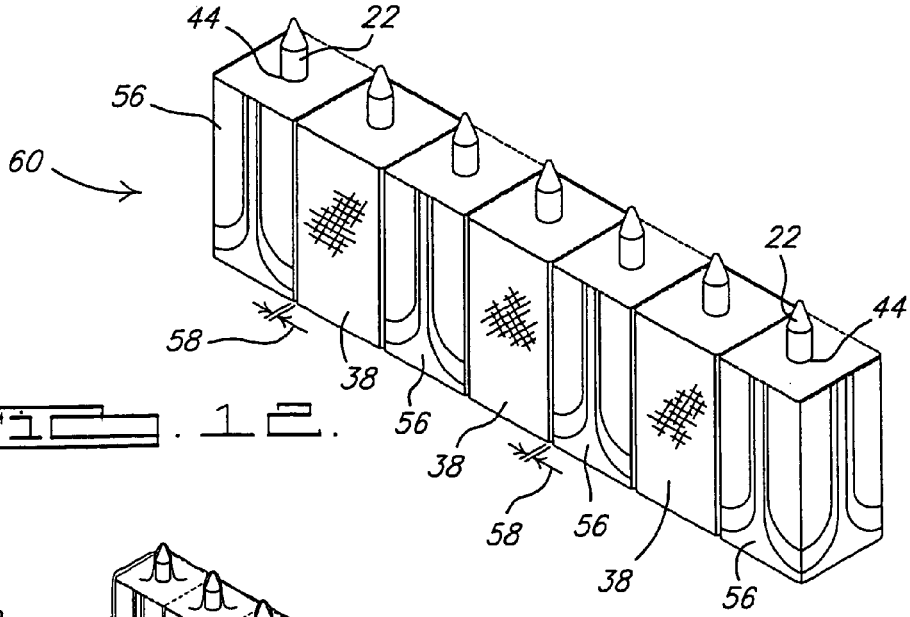
FIG. 12 illustrates one row of antenna components being arranged adjacent to one another, where certain components do not have antenna radiating elements placed thereon.

Referring to FIG. 12, a desired plurality of antenna components 56 are arranged in a row with a plurality of subassembly components 38 disposed between adjacent ones of the antenna components 56. Subassembly components 38 essentially act as spacers that ultimately help form the wall portion 16 of the completed antenna aperture 10. When two subassembly components 38 are positioned on opposite sides of a given component 56, an overall wall thickness, designated by arrows 58, will be just slightly larger than twice that of the wall thickness 55 (FIG. 7) of the subassembly component 38. Thus, the wall thickness 55 is selected with the understanding that it should be just slightly more than half of the desired final thickness for each of the walls that will make up the honeycomb-like core of the aperture 10.

Figure 13:
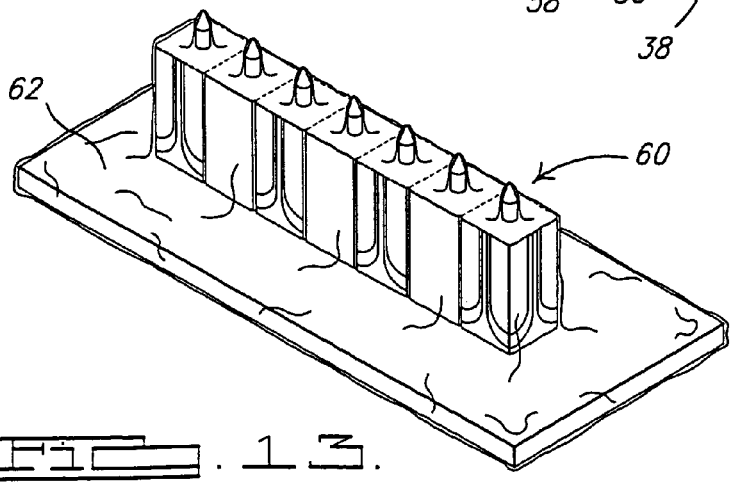
FIG. 13 illustrates the subassembly of FIG. 12 placed within a compaction bag for vacuum compacting.

Referring to FIG. 13, a row of components 56 and 38, designated for convenience by reference numeral 60, is placed within a vacuum bag 62 and vacuum compacted by a suitable compaction tool to produce a tightly compacted row of components. This compaction step also serves to remove air between the sheets of radiating components 48 and to tightly compact them onto the prepreg fabric 30 over which they are secured.

Figure 14:
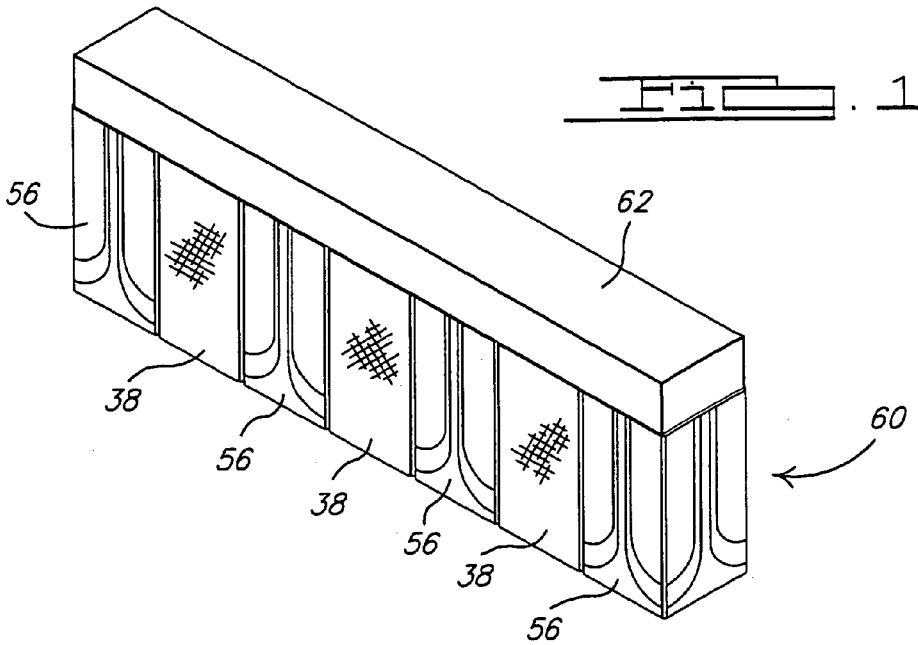
FIG. 14 illustrates a metallic top plate element being placed over the subassembly of FIG. 12 after the subassembly has been vacuum compacted.
Figure 15:
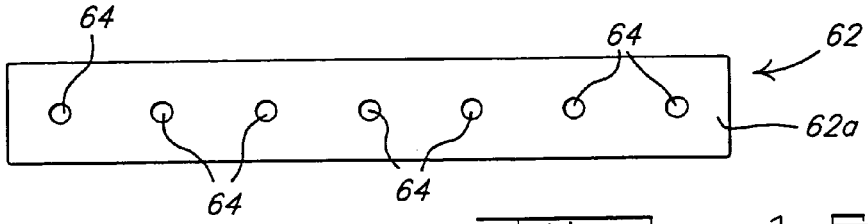
FIG. 15 illustrates a view of a bottom surface of the top plate of FIG. 14.

Referring to FIG. 14, the row 60 is then covered with a top plate 62, which may be made from aluminum or another metal. Plate 62 is shown in FIG. 15 and includes a lower surface 62*a* having a plurality of precisely located recesses 64. The recesses 64 receive each of the locating pins 22 of each antenna radiating component 56 and each subassembly component 38. Top plate 62 may require some force, such as one or more blows of a hammer, to seat all of the locating pins 22 in the recesses 64. Top plate 62 serves to hold each of the components 56 and 38 in a precise linear orientation and tightly against one another during a subsequent compaction operation. Row 60 will be used to form an internal row of antenna cells 12 for the antenna aperture 10.

Figure 16:
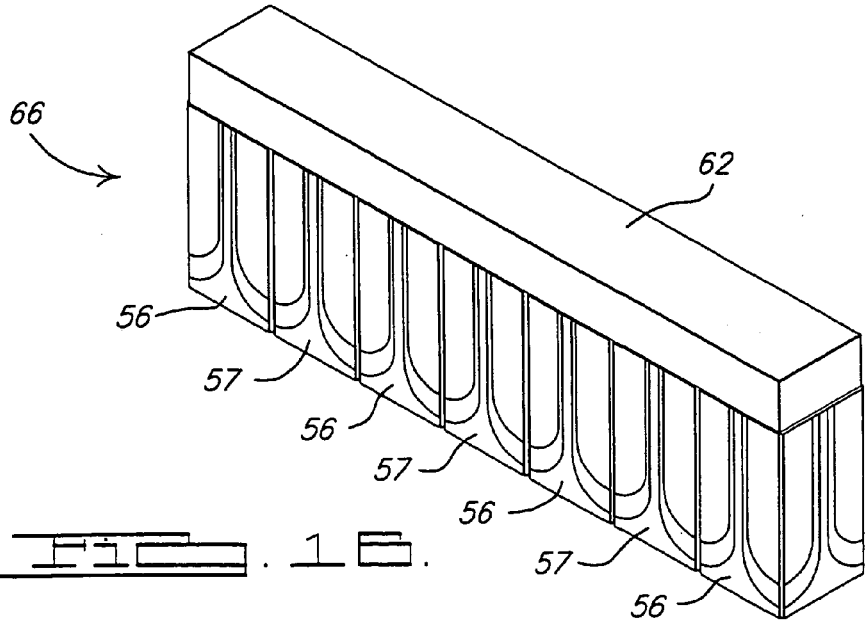
FIG. 16 illustrates the top plate being used to form a different row of components that will eventually form an outer wall of the antenna aperture of FIG. 1.

Referring to FIG. 16, a row 66 is used to form an exterior wall of the array 10 as shown in FIG. 1. Row 66 includes a compacted row of antenna components 56 and antenna components 57. A top plate 62 is also shown secured to the row 66. For a perimeter wall portion of the array of antenna cells 12, the areas in between the antenna components 56 (that have radiating elements 42 on all four sides) need only to be filled with radiating components having two sides covered with dipole radiating elements 42. Components 57 are identical to components 56 except they only include a single radiating component strip 48 that presents dipole radiating elements on one opposing pair of sides of the subassembly component 38.

Figure 17:
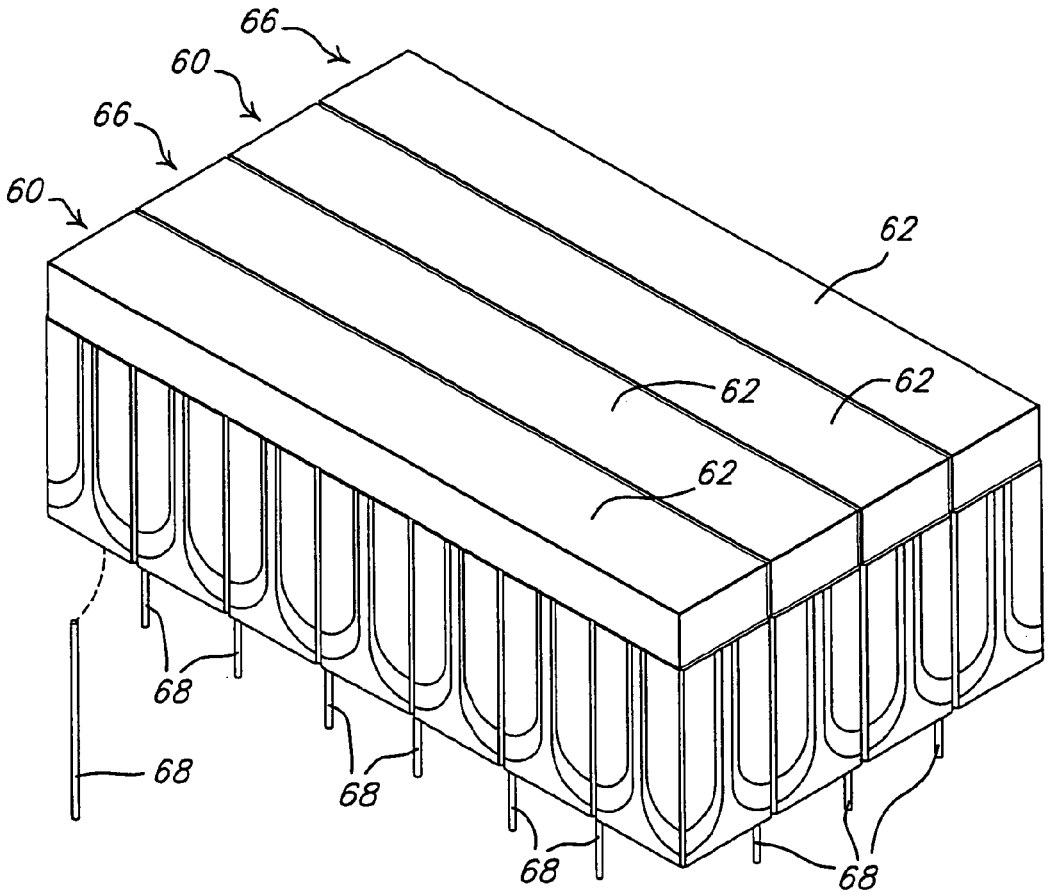
FIG. 17 shows a plurality of rows of components arranged adjacent one another with interstitial spacers being placed at the interstitial joints of adjacent components.
Figure 18:
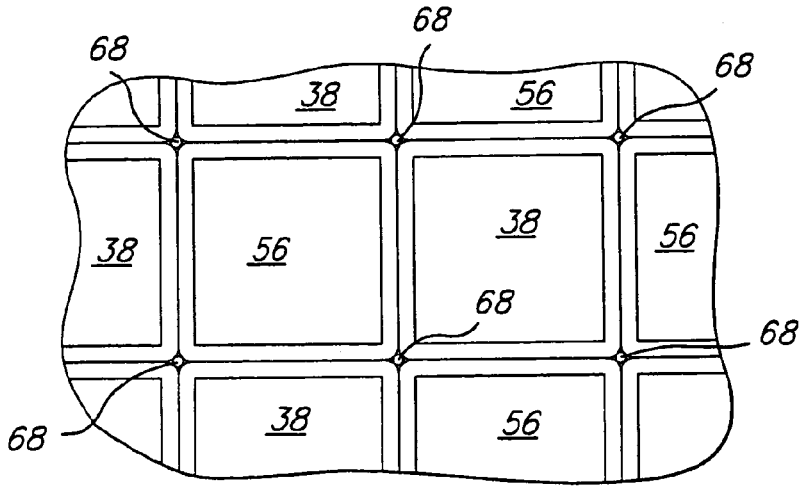
FIG. 18 shows a bottom view of the subassembly of FIG. 17 with the placement of the interstitial filler components at the interstitial areas.

Referring to FIGS. 17 and 18, rows 60 and 66 are aligned into columns and radius filler components 68 are placed in every corner where two or four of the components 56, 57, and 38 meet. The desired number of rows 60, 66 incorporated varies depending upon the overall number of antenna cells 12 that are required for a specific application. Radius fillers 68 preferably comprise 0° prepreg tape fillers having a sufficient volume (i.e., diameter) to substantially fill the interstitial areas at the corners where two or four of the components 56, 57 or 38 meet. Radius fillers 68 may comprise rolled sections of 0° prepreg tape, sections of prepreg tape or pultrusion-formed sections of prepreg material. Radius fillers 68 are preferred for filling the interstitial areas to prevent weak spots in the honeycomb-like wall structure of the completed antenna aperture 10.

Figure 19:
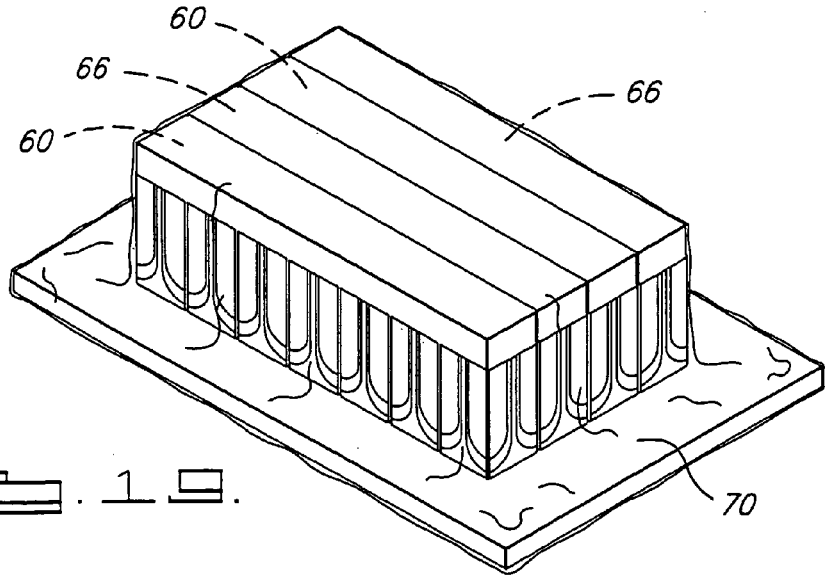
FIG. 19 shows the subassembly of FIG. 17 placed within a vacuum bag for vacuum compacting.

Referring to FIG. 19, the arranged rows 60 and 66, together with the interstitial radius filler components 68, are covered with a vacuum bag 70 of a vacuum compaction tool and compacted to form a tightly held subassembly.

Figure 20:
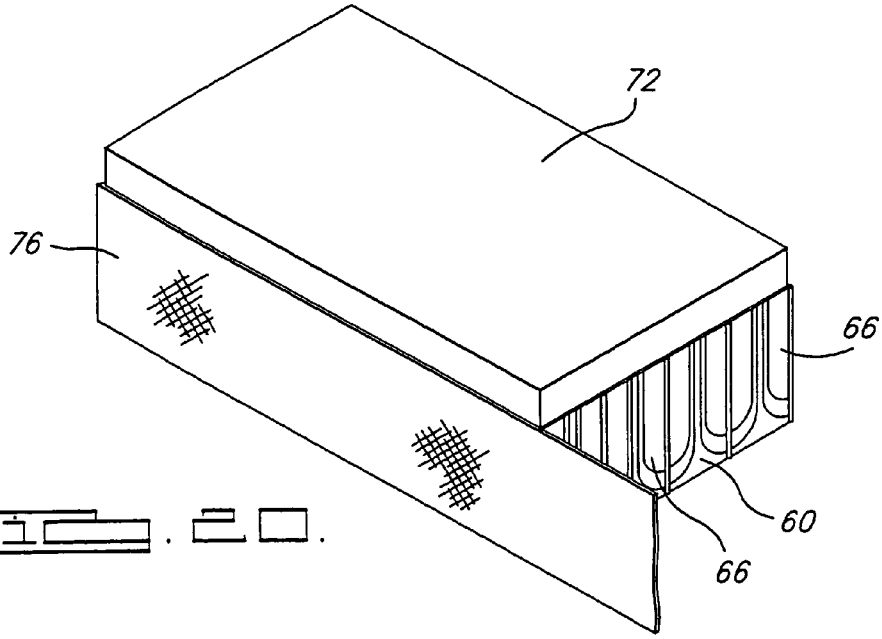
FIG. 20 shows the compacted subassembly of FIG. 19 with a single top plate disposed thereon, and being wrapped with a length of prepreg fabric that will form a perimeter wall of the antenna aperture.
Figure 21:
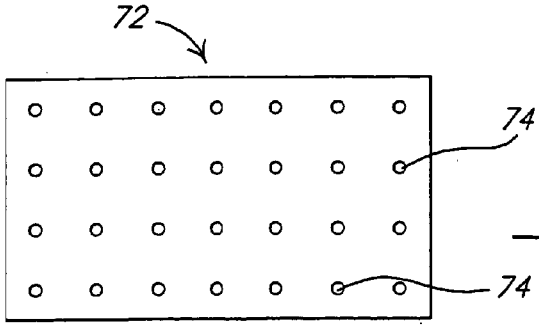
FIG. 21 is a bottom view of the top plate shown in FIG. 20.

Referring to FIG. 20, the compacted subassembly of FIG. 18 is removed from the compaction tool, top plates 62 are removed from each of the components 56, 57 and 58, and a single metallic top plate 72 made from aluminum or other metallic material is secured to the locator pins 22 of each metallic element 20. A bottom view of top plate 72 is shown in FIG. 21. Top plate 72 includes a plurality of recesses 74 laid out in a precise X-Y grid designed to receive the locating pins 22. Again, some degree of force, for example, from several blows of a hammer, will likely be needed to fully seat each of the locating pins 22 in the respective recesses 74. However, the tapered contour of each locating pin 22 assists in facilitating seating within its respective recess 74. Top plate 72 holds each of components 56, 57 and 58 tightly in a precise arrangement for subsequent assembly and compaction operations.

With further reference to FIG. 20, one or more additional layers of resin-rich prepreg fabric 76 are then wrapped around the perimeter walls of the subassembly of rows 60 and 66. Prepreg fabric 76 can vary in thickness but is preferably within the range of about 0.010"–0.020" (0.254–0.508 mm), and more preferably about 0.015" (0.381 mm) in thickness. The use of prepreg layer 76 allows the exposed, perimeter wall of the antenna aperture 10 to be formed with a thickness that approximates the thickness of interior wall portions, such as wall portion 16*a* in FIG. 1, where two adjacent components 38, 56 or 57 are placed adjacent one another.

Figure 22:
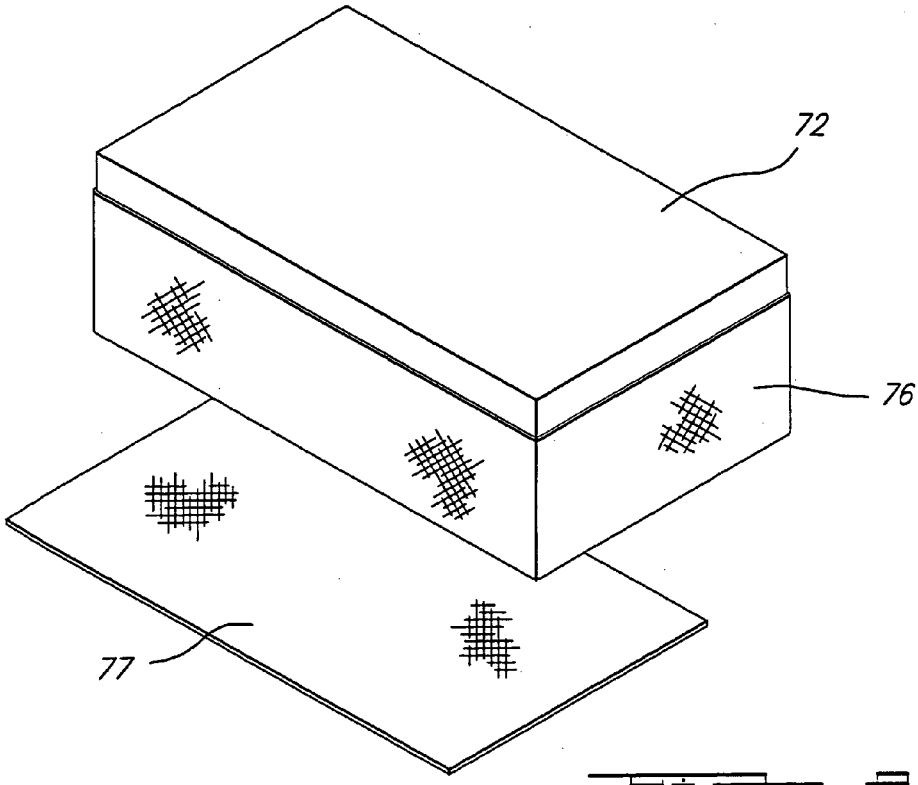
FIG. 22 illustrates the subassembly of FIG. 20 being placed over a back skin that will form a bottom wall of the antenna aperture.
Figure 23:
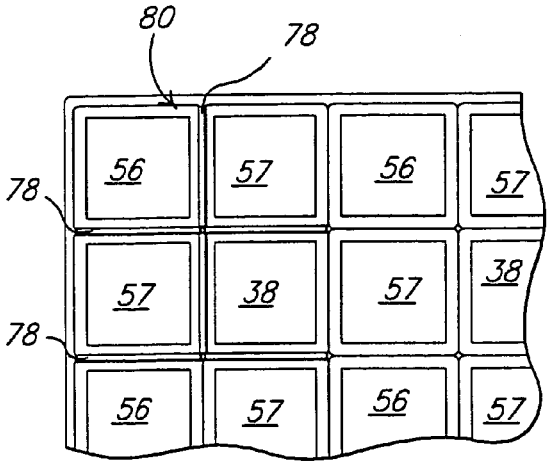
FIG. 23 shows a bottom view of the subassembly of FIG. 22 without the back skin illustrating how fillers are placed at the interstitial areas along the sidewalls of the antenna components making up the antenna aperture.

Referring to FIG. 22, the subassembly of FIG. 20, with one or more layers of prepreg fabric 76 wrapped around the perimeter of the assembled rows 60 and 66, is then placed on a back skin 77. Back skin 77 comprises a pre-cured layer of prepreg material or an uncured layer of prepreg material. The length and width of back skin 77 closely approximates the overall length and width of the assembled rows 60 and 66. With brief reference to FIG. 23, radius fillers 78 are also added to the lower surface 80 of the assembled rows 60 and 66 prior to placing same on the back skin 77 In practice, the back skin 77 is lowered onto the lower surface 80 after the radius fillers 78 are in place, and then the entire assembly may be flipped 180° to present the back skin 77 beneath the rows 60 and 66.

Figure 24:
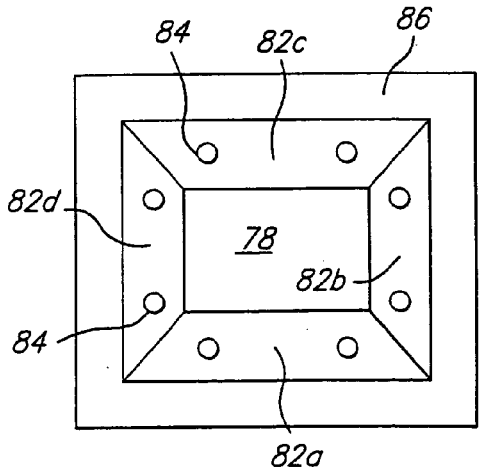
FIG. 24 illustrates the subassembly of FIG. 22 placed within a tool for further compaction and curing.
Figure 25:
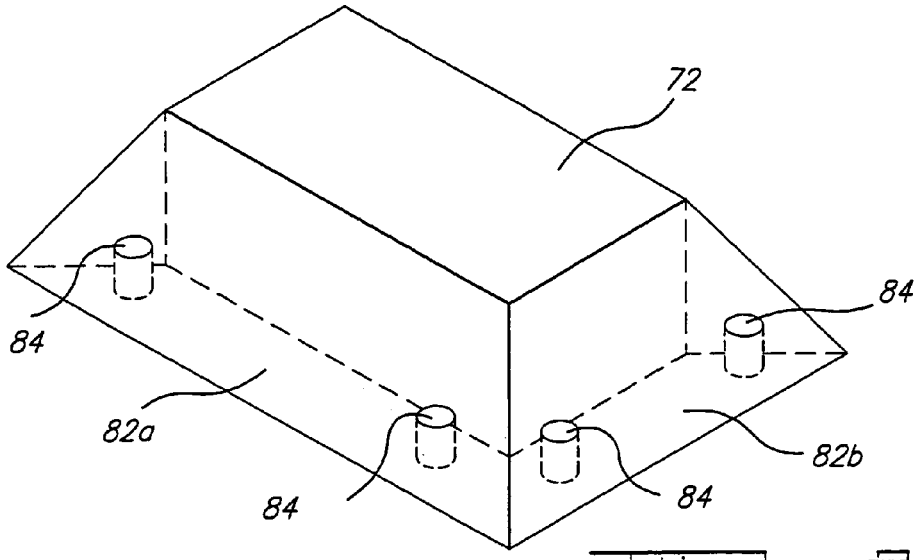
FIG. 25 is a perspective view of the tool shown in FIG. 24.
Figure 26:
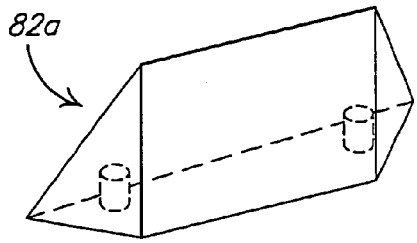
FIG. 26 is a perspective view of one component of the tool shown in FIG. 25

Referring to FIGS. 24 and 25, a plurality of metallic tools 82*a*–82*d* are placed around the perimeter of the subassembly of rows 60 and 66 and held stationary via pins 84 to a tool platform or surface 86. Tools 82*a*–82*d* preferably comprise Invar and are preferably slightly triangular in cross-section to provide a tapered surface that eases the task of placing a compaction bag over the tools 82*a*–82*d*. Tool 82*a* is shown in greater detail in FIG. 26. Top plate 72 may be formed from various metallic materials but is also preferably formed from Invar. The pins 84 assure that the tools in 82*a*–82*d* hold the rows 60 and 66 stationary in a tightly held, highly precise alignment. Invar is preferred because it has a high nickel content (typically 36% or 42%), which gives it a coefficient of thermal expansion substantially similar to the component prepreg material used for the fabric 30 and fabric 76. Aluminum is a preferred material for the metallic elements 20. Aluminum expands at a faster rater than Invar and thus helps facilitate compressing the prepreg fabric 30 and fabric 76 during a cure phase.

Figure 27:
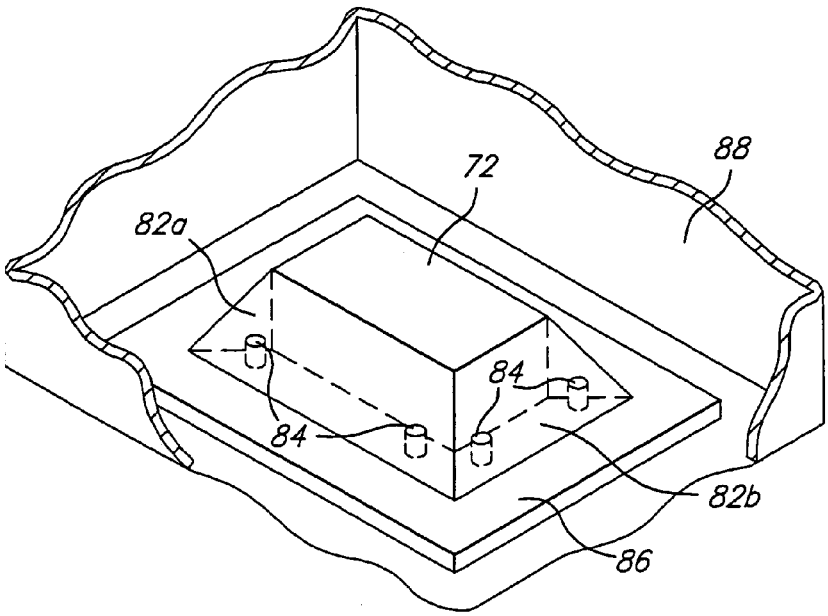
FIG. 27 shows the tool of FIG. 25 placed within an oven or autoclave.

The subassembly shown in FIG. 27 then is covered with a compaction bag, and placed in an oven 88 or autoclave for curing. The metallic elements 20, which are preferably formed from aluminum, expand as they are heated to provide the compacting force that compacts each of the rows 60 and 66 tightly together. Curing is accomplished by maintaining the subassembly by FIG. 25 in the oven 88 for a period of typically between 4–6 hours at a temperature of typically about 250° F. (121° C.). During this curing period, metallic elements 20 typically grow on the order of about 0.005" (0.127 mm) in cross-sectional shape. If an autoclave is used, the pressurization used is preferably about 85 pounds per square inch. During the cure period, the wall thickness formed by pairs of adjacent wall portions of each pair of components 38, 56, and/or 57 will typically shrink by 0.002"–0.003" (0.0508–0.0762 mm).

Figure 28:
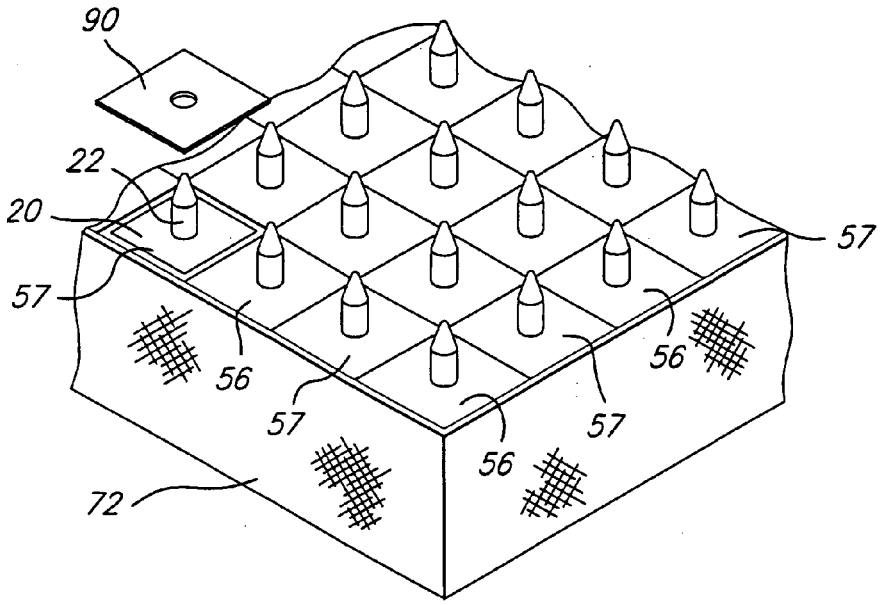
FIG. 28 illustrates a top portion of one antenna component being removed after being cut to allow removal of the metallic element.
Figure 29:
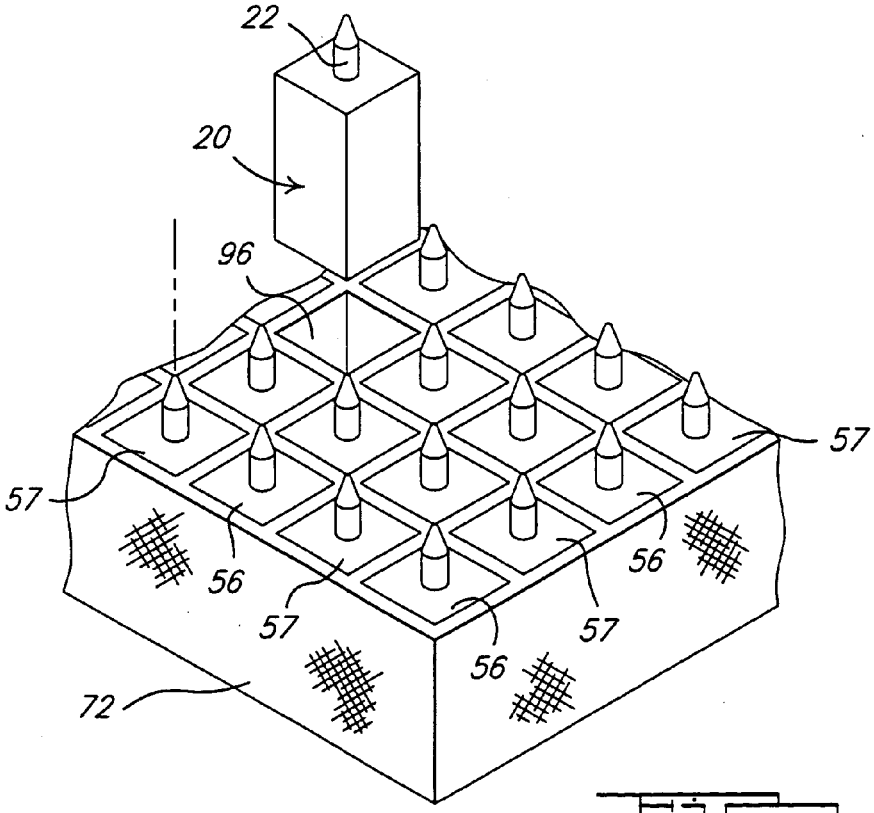
FIG. 29 illustrates the metallic element being removed from a cell of the newly formed antenna aperture.

Referring to FIG. 28, the subassembly shown in FIG. 27 is removed from oven 88, the tools 82*a*–82*d* are removed, and the top plate 72 is removed to reveal the compacted and cured subassembly of rows 60 and 66. The four upper edges 90 of each component 38, 56 and 57 are cut with a utility knife, and portion 92 of each antenna radiating component 48 is removed. At FIG. 29, each of the metallic elements 20 are removed, such as by grasping the locating pin 22 with a pair of pliers and pulling upwardly in accordance with arrow 94 to reveal an open cell 96. The polished exterior surface of each metallic element 20 helps to allow removal of the element 20.

Figure 30:
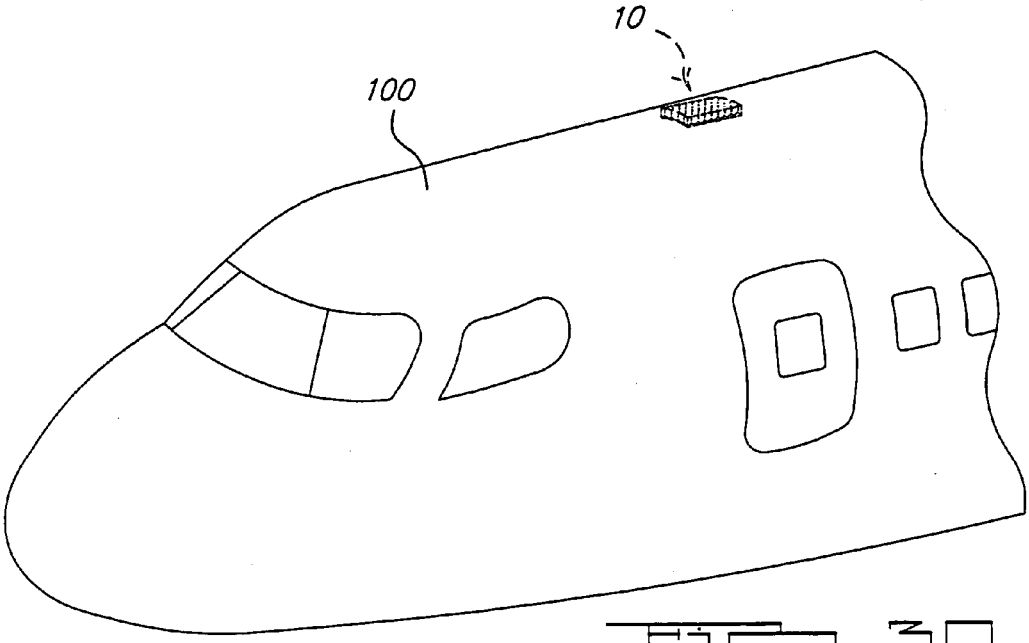
FIG. 30 illustrates an antenna aperture in accordance with a preferred embodiment of the present invention integrated into a portion of the fuselage of an aircraft.

Once all of the metallic elements 20 have been removed, the antenna aperture 10 appears as shown in FIG. 1. At this point, one or more subsequent manufacturing steps may be performed to secure an additional layer of prepreg material over an upper surface 98 (FIG. 28) of the antenna aperture 10 to form a radome, or other suitable manufacturing steps may be performed to integrate the antenna aperture 10 as needed into an airframe or other structural subassembly. FIG. 30 illustrates the antenna aperture 10 integrated into a fuselage 100 of an aircraft.

Referring further to FIG. 1, each of antenna radiating elements 14 have a feed portion 14*a* that is coupled to antenna electronic components, typically located on an external printed wiring board. The printed wiring board is positioned adjacent the feed portions 14*a* and conventional fuzz buttons or any other suitable attachment means can be employed for electrically coupling the feed portions 14*a* to their associated electronic components. Various means of making such electrical connections are discussed in U.S. Pat. No. 6,424,313 to Navarro et al., incorporated by reference into the present application, and owned by The Boeing Company.

Figure 31:
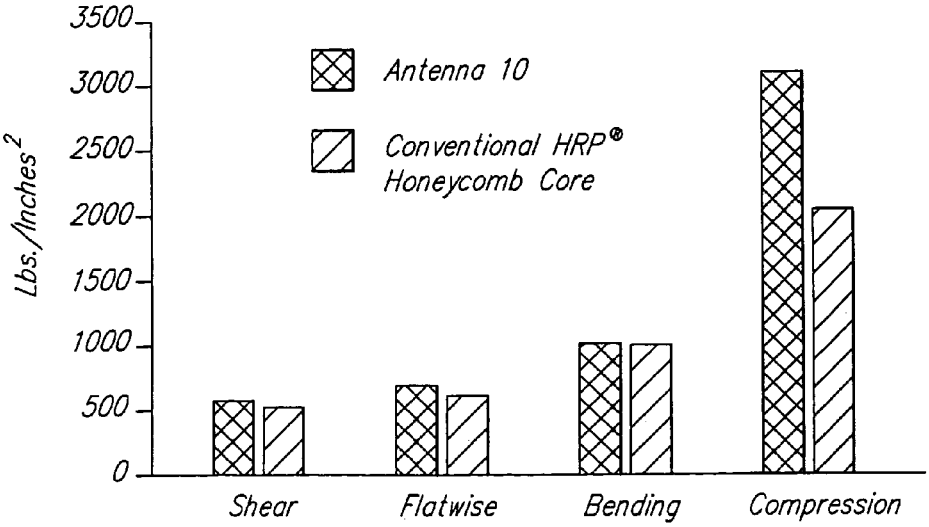
FIG. 31 illustrates the approximate strength characteristics of the antenna aperture relative to an HRP® of fiberglass honeycomb structure of comparable weight.

The completed antenna aperture 10 (i.e., with a back skin and a radome bonded to the aperture) has load bearing characteristics similar to those provided by HRP® fiberglass honeycomb load bearing structures used in present day airframes. This is illustrated in FIG. 31. The back skin and radome add an additional degree of strength to the aperture 10.

The manufacturing method described herein allows precise dimensional control over the formation of the antenna cells 12 of the antenna aperture 10 as needed to provide the required RF performance characteristics. The method also allows apertures to be economically formed in widely varying sizes and shapes as needed to suit the needs of a specific application. An important advantage is that the parasitic weight of the antenna aperture 10 is significantly reduced because of the absence of metallic mandrels or other supporting structures on which various electronic components and antenna radiating elements would otherwise be mounted. This allows the antenna structure 10 to be employed in structures such as airborne mobile platforms, where the weight of the aperture 10 is an important consideration.

The method of manufacture of the antenna aperture 10 also enables close control over spacing of antenna elements that is crucial in forming an antenna aperture having hundreds or thousands of independent radiating elements. Precise spacing is important because each of the antenna elements need to be electrically interfaced with other electronics components or circuit faces on an antenna electronics board. Spacing is also important when designing an aperture that is required to operate in the GHz band.

The antenna array 10 could also be used in forming extremely large antenna array assemblies where a plurality of arrays would be mechanically and/or electrically linked together to form a single, enlarged array of apertures.

While various preferred embodiments have been described, those skilled in the art will recognize modifications or variations which might be made without departing from the inventive concept. The examples illustrate the invention and are not intended to limit it. Therefore, the description and claims should be interpreted liberally with only such limitation as is necessary in view of the pertinent prior art.

What is claimed is:

1. An antenna aperture comprising:

a plurality of independent antenna cells formed in a honeycomb-like core structure;

each of said antenna cells including:

a material forming a wall portion;

an antenna element embedded in said wall portion;

said antenna element including a layer of non-conductive material having an electrically conductive material thereon forming electromagnetic radiating elements; and wherein said electromagnetic radiating elements are sandwiched between a pair of layers of composite material that comprise wall portions for said honeycomb-like core structure.

2. The antenna aperture of claim 1, wherein said antenna element comprises an electromagnetic wave antenna element.

3. The antenna aperture of claim 2, wherein said electromagnetic wave antenna element comprises a dipole antenna element.

4. The antenna aperture of claim 1, wherein each antenna cell comprises a cross sectional square shape.

5. The antenna aperture of claim 4, wherein each said antenna cell comprises a first pair of dipole antenna elements.

6. The antenna aperture of claim 4, further comprising a second pair of dipole antenna elements disposed on said wall portion of said antenna cell.

7. The antenna aperture of claim 1, wherein material comprises a composite material.

8. The antenna aperture of claim 1, wherein said non-conductive material comprises a layer of polymide film having copper, and wherein the copper forms said electromagnetic radianting elements.

9. The antenna aperture of claim 1, further comprising a back skin secured to said honeycomb-like core structure.

10. A method of forming an antenna able to act as a integral, load-bearing portion of a structure, comprising:

forming a plurality of antenna cells by:

wrapping a plurality of metallic blocks with independent sections of prepreg fabric;

compacting said prepreg fabric sections on said metallic blocks;

disposing flexible layers of material each having formed thereon an antenna element, on each composite prepreg fabric section;

arranging said antenna cells in a honeycomb-like grid;

wrapping a perimeter of said grid with a fabric such that said antenna elements are embedded in between layers of said fabric;

compacting said grid to form a honeycomb-like core structure;

curing said honeycomb-like core structure; and removing said metallic blocks from each of said antenna cells.

11. The method of claim 10, wherein disposing a flexible layer of material having an antenna element comprises disposing a first flexible layer of Kapton® polyimide film having a first dipole antenna element formed from copper.

12. The method of claim 11, further comprising disposing a second flexible layer of material on each said antenna cell, the second flexible layer of material comprising a flexible layer of Kapton® polyimide film having a second dipole antenna element formed from copper, and arranged non-parallel to said first dipole antenna element.

13. The method of claim 10, further comprising wrapping each metallic block with a plurality of independent sections of fabric each ranging in thickness between about 0.005 inch–0.015 inch (0.127 mm–0.381 mm).

14. The method of claim 10, wherein said metallic blocks each comprise solid aluminum blocks.

15. The method of claim 14, wherein said solid aluminum blocks have a polished outer surface.

16. The method of claim 15, wherein said solid aluminum blocks each comprise approximately 0.5 inch (12.7 mm) square shaped blocks.

17. The method of claim 10, further comprising securing a backskin to said honeycomb-like core structure.

18. A method of forming a structural portion of a mobile platform having an integrally formed antenna array, comprising:

forming a plurality of tubular, multi-sided structural cells each comprised of a composite, prepreg material, on independent metallic blocks;

wrapping a length of flexible material having an antenna element thereon, on each said structural cell to form a plurality of independent, multi-sided antenna cells;

arranging said antenna cells in an X-Y grid to form a honeycomb-like core structure;

wrapping a perimeter of the honeycomb-like core structure with a composite prepreg fabric;

compacting the honeycomb-like core structure;

curing the honeycomb-like core structure; and removing the metallic blocks.

19. The method of claim 18, further comprising compacting the structural cells prior to arranging the structural cells in said X-Y grid.

20. The method of claim 18, wherein wrapping a length of flexible material comprises wrapping a first length of flexible material having a first pair of dipole antenna elements formed thereon, the first pair of dipole antenna elements being arranged generally parallel and in opposing fashion on said metallic block.

21. The method of claim 18, further comprising wrapping a second length of flexible material having a second pair of dipole antenna elements formed thereon, on said metallic block, non-parallel to said first pair of dipole elements, to form a dual polarization antenna cell.

22. The method of claim 18, further comprising forming spacer metallic blocks wrapped with composite, prepreg material wrapped, and disposing said spacer metallic blocks in between adjacent ones of said antenna cells prior to wrapping the perimeter of the X-Y grid with said composite, prepreg fabric.

23. The method of claim 18, wherein curing the honeycomb-like core structure comprises heating the structure in an oven having a temperature of between about 200°–300° F. (93.3°–148° Celsius).

24. The method of claim 18, wherein curing the honeycomb-like core structure comprises heating the structure in an autoclave.

25. The method of claim 18, further comprising securing one surface of the honeycomb-like core structure to a composite panel adapted to form a portion of a skin of the airframe.

* * * * *

UNITED STATES PATENT AND TRADEMARK OFFICE

CERTIFICATE OF CORRECTION

PATENT NO. : 7,109,942 B2
APPLICATION NO. : 10/970702
DATED : October 21, 2004
INVENTOR(S) : Douglas A. McCarville et al.

It is certified that error appears in the above-identified patent and that said Letters Patent is hereby corrected as shown below:

Title page, item [75] Inventor "Isaac R. Bakker" should read -- Isaac R. Bekker --.

Signed and Sealed this

Tenth Day of July, 2007

JON W. DUDAS
*Director of the United States Patent and Trademark Office*

UNITED STATES PATENT AND TRADEMARK OFFICE

CERTIFICATE OF CORRECTION

PATENT NO. : 7,109,942 B2
APPLICATION NO. : 10/970702
DATED : September 19, 2006
INVENTOR(S) : Douglas A. McCarville et al.

It is certified that error appears in the above-identified patent and that said Letters Patent is hereby corrected as shown below:

Title page, item [75] Inventor "Isaac R. Bakker" should read -- Isaac R. Bekker --.

This certificate supersedes Certificate of Correction issued July 10, 2007.

Signed and Sealed this

Thirty-first Day of July, 2007

JON W. DUDAS
*Director of the United States Patent and Trademark Office*